United States Patent [19]

Sandler

[11] 3,964,603

[45] June 22, 1976

[54] RING DISPLAY WITH LOCKING MECHANISM

[76] Inventor: H. R. Sandler, 4914 Brassvalley St., Houston, Tex. 77035

[22] Filed: Jan. 16, 1975

[21] Appl. No.: 541,502

[52] U.S. Cl. ..... 206/76; 211/4

[51] Int. Cl.[2] ..... B65D 1/34; E05B 73/00

[58] Field of Search ..... 206/76; 211/4

[56] References Cited

UNITED STATES PATENTS

| | | | |
|---|---|---|---|
| 267,090 | 11/1882 | Lewkowitz | 206/76 |
| 914,563 | 3/1909 | Fowler | 206/76 |
| 2,987,192 | 6/1961 | Metzler et al. | 211/4 |
| 3,204,774 | 9/1965 | Barbieri | 206/76 X |

*Primary Examiner*—Leonard Summer

[57] ABSTRACT

Disclosed herein for displaying rings and the like is a display case that has an improved locking mechanism. The mechanism contains a plate having slots through which rings are inserted partially. A hook is located below each slot, retaining the ring when the hook is rotated forward. The lower end of each hook is connected to a rotatable rod aligned under each row of slots. An actuator perpendicular to each rod rotates the rod upon being pulled or pushed by means of linkage bars. Each linkage bar is rigidly fastened at one end to one of the rods and pivotally connected to the actuator at the other end.

1 Claim, 3 Drawing Figures

RING DISPLAY WITH LOCKING MECHANISM

BACKGROUND OF THE INVENTION

1. Field of the Invention

This invention relates in general to ring display cases and in particular to a mechanism for locking rings in a display case.

2. Description of the Prior Art

A common type of display case has several rows of slots in a soft material in which rings are placed. A disadvantage of this type of display is that much of the ring remains hidden, leaving only the upper part for viewing. Also unless a glass covers the top of the case, rings might easily be stolen. If there is a glass cover, a prospective purchaser is unable to touch the ring or inspect closely unless a sales attendant is present.

There are prior art locking devices for ring displays, one of which is described in U.S. Pat. No. 3,204,774 issued Sept. 7, 1965. That device utilizes a sliding plate below an upper plate which contains slots. The lower plate has matching slots, but a tab is formed in each slot so that when the plate is moved forward, the ring is retained. While this device is successful, improvements are desirable.

One of the objects of this invention is to provide an improved ring display with a locking mechanism which allows rings to be handled but not withdrawn and is easily unlocked in the rear by a sales attendant. Another object is to provide a display case with a locking mechanism which utilizes rotatable rods and hooks aligned below each slot to minimize sliding contact and simplify construction. Additional objects, features and advantages of the invention will become apparent in the following description.

DESCRIPTION OF THE PREFERRED EMBODIMENT

Figure 1:
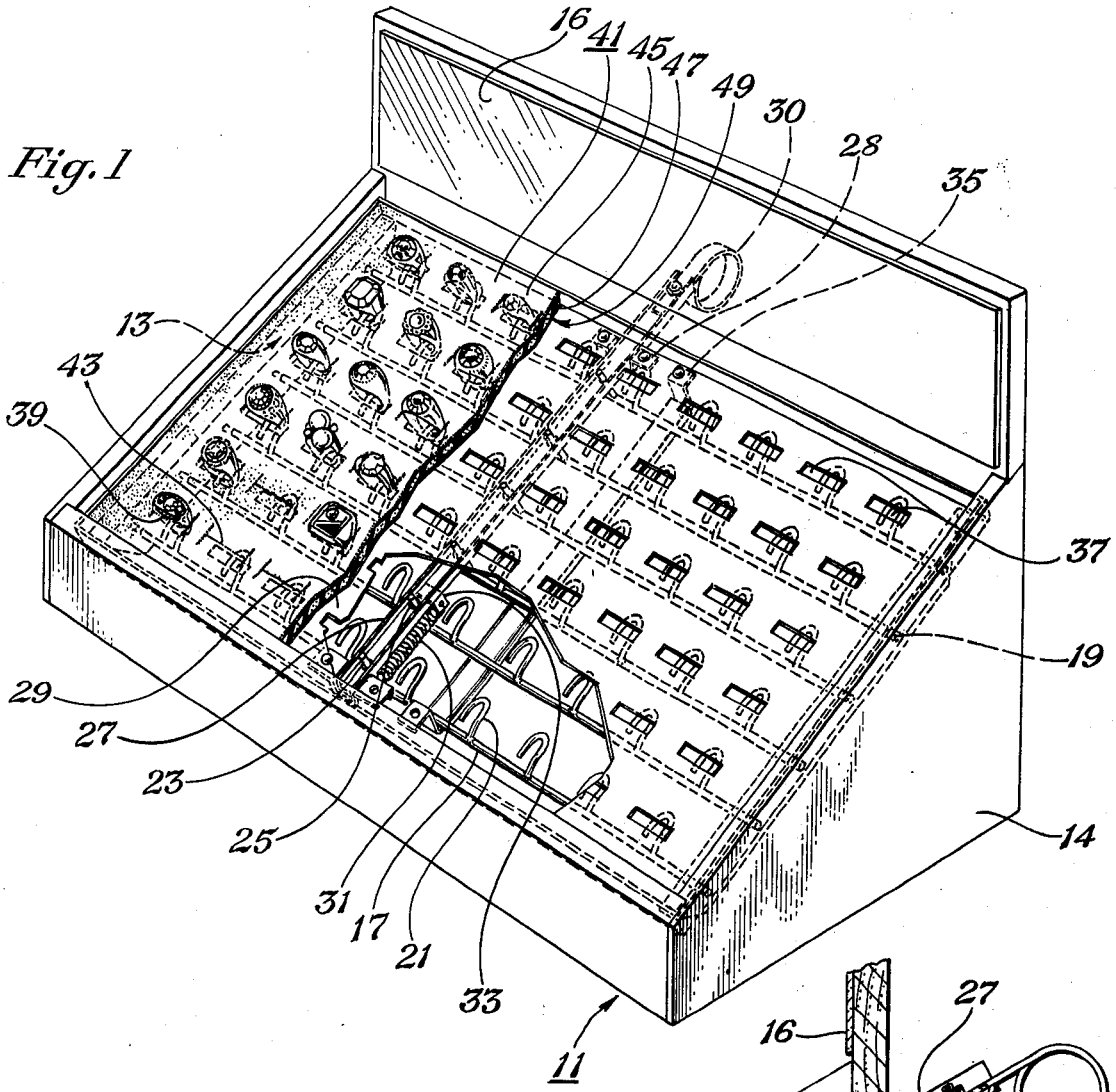
FIG. 1 is an isometric view of a display case partially broken away to show a locking mechanism constructed in accordance with this invention.
Figure 3:
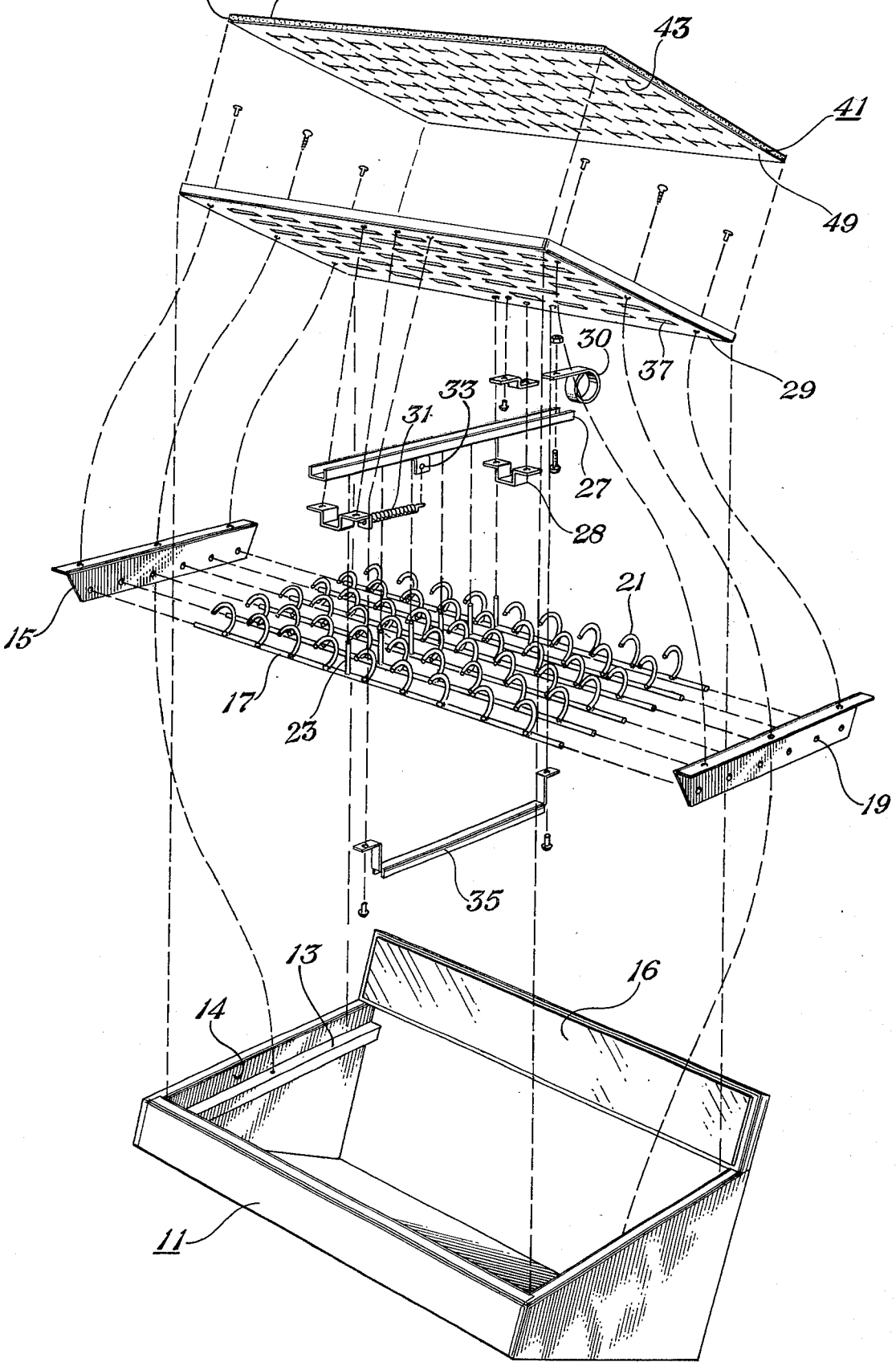
FIG. 3 is an exploded isometric view of the display case of FIG. 1.

With reference to FIGS. 1 and 3, a case 11 provides support for the locking mechanism. The case 11 is a rectangular box having an open diagonally sloping top. Shoulders 13 comprised of two rectangular brackets run parallel to the open top of case 11 and are attached to the sides 14 of case 11. In the preferred embodiment, the case 11 and shoulders 13 are wood, and a mirror 16 is attached for enhancing the ring display.

Figure 2:
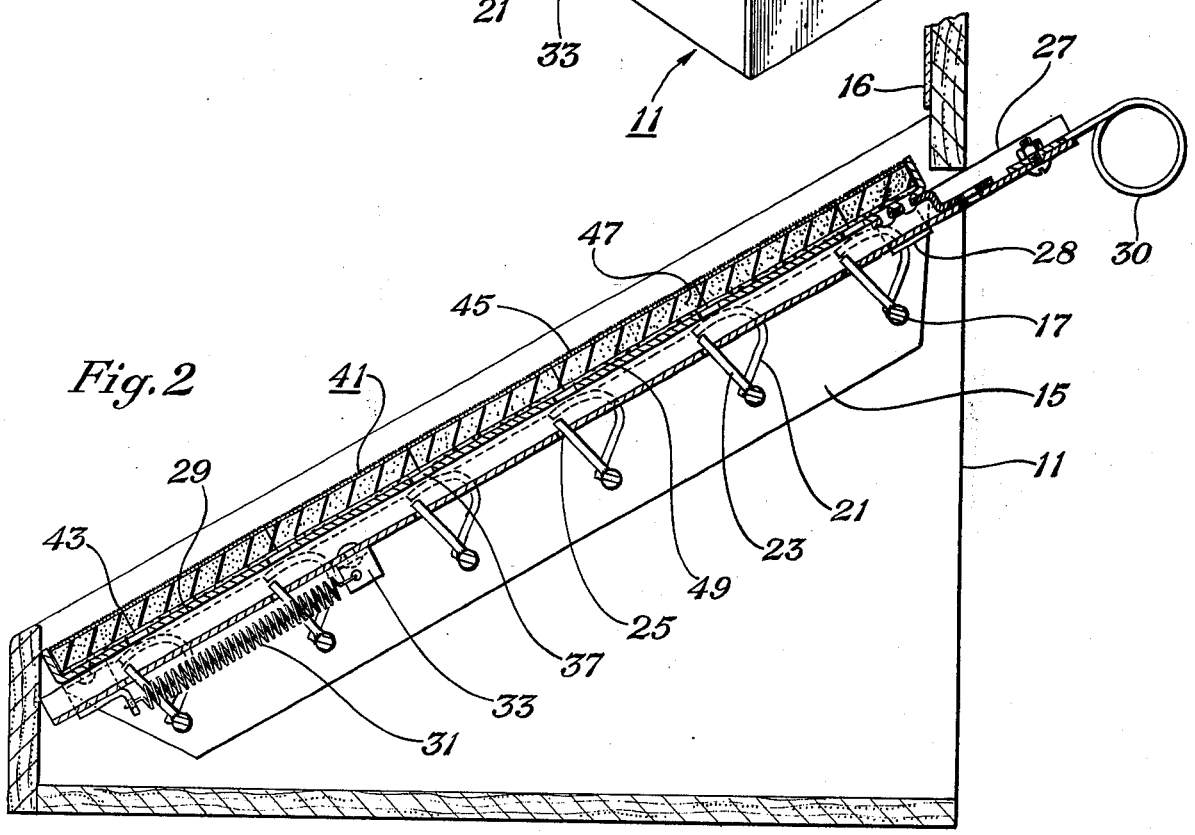
FIG. 2 is an enlarged elevational section view of the display case of FIG. 1 while the mechanism is in a ring retaining position.

The locking mechanism is carried by the case 11 through shoulders 13 to which frames 15 are attached. The two frames 15 are metal plates having a plurality of holes 19 through which rods 17 fit loosely so that the rods 17 are rotatable. The rods 17, aligned substantially parallel to the front and rear sides of case 11, have a plurality of curved hooks 21 attached to and extending above and perpendicular to the rods 17. Also, as more clearly shown in FIG. 2, one linkage bar 23 is secured to each rod 17. The rods 17, hooks 21, and linkage bars 23 are heavy metal wire, with the hooks 21 and linkage bars 23 attached by welding or soldering to the rods 17.

The upper ends of linkage bars 23 extend loosely through a hole 25 in actuator 27, forming a pivotal connection. Actuator 27 is a metal channel-shaped member extending above and substantially perpendicular to the rods 17. Actuator 27 is carried loosely by brackets 28 attached to plate 29 so that it is movable transverse to rods 17. Linkage means, shown as linkage bars 23 in the preferred embodiment, acting in conjunction with actuator 27 serve as actuator means to rotate rods 17 forwardly in a ring retaining and rearwardly in a ring release position.

Handle 30 is attached to actuator 27 to aid in moving forwardly and rearwardly. Coil spring 31 attached between front bracket 28 and a tab 33 on actuator 27 serves as biasing means urging actuator 27 forward in a ring retaining position. Brace 35 attached to plate 29 and extending below rods 17 provide additional support for rods 17.

Located above hooks 21 is plate 29, which is carried by case 11 through shoulders 13. Plate 29, normally metal and rectangular in the preferred embodiment, contains slots 37 through which rings 39 may be inserted. A slot 37 is spaced above each hook 21 and the rods 17 are aligned substantially parallel to the long side of each slot 37.

A covering 41 over plate 29 enhances the appearance of the device and provides a light friction fit in slit 43 through which a ring 39 is inserted. The covering 41 may be of an attractive soft top layer 45, such as velvet, a thin layer of padding 47, such as foam-rubber or foam-thermo plastic, and bottom layer 49 of cardboard or the like. The covering 41 composition of course may be varied.

To place the device in ring release position, actuator 27 is manually drawn rearward, rotating rods 17 by means of linkage bars 23. The upper curved end of a hook 21 withdraws from its ring retaining position immediately under and near the center of slot 37, and a ring 39 may be either inserted or withdrawn. If actuator 27 is released, spring 31 pulls the actuator forward which rotates rods 17 and hooks 21. The upper end of hook 21 is positioned sufficiently close to plate 29 such that if a ring is inserted through slot 37, the hook 21 enters the ring opening and retains the ring. The slots 37 may vary in size but are large enough such that a sufficient portion of the ring extends below slot 37 to be engaged by hook 21. If desired the actuator 27 may be locked in a ring retaining position by a padlock.

Other embodiments are readily apparent, such as providing more than one actuator 27 so that only certain rows may be opened by one actuator and other rows by another actuator. Other actuator means to rotate the rods 17 are apparent, such as means on the sides of case 11. Moreover other linkage means from the actuator 27 to rods 17 are feasible such as positioning the actuator 27 below rod 17, in which case the mechanism may be placed in ring release position by pushing the actuator forward rather than pulling as in the preferred embodiment previously described.

It may readily be seen that an invention having significant advantages has been provided. Rings are attractively displayed without a glass covering so that they may be touched, yet are safe from theft. A sales attendant can easily unlock the case from the rear for withdrawal. The relatively thin padded covering allows practically the entire ring to be displayed above the slot. The combination of a rod rotating a hook below a slot provides a locking mechanism with a minimum of sliding contact eliminating the need for high tolerances in manufacturing.

The foregoing disclosure and the showings made in the drawings are merely illustrative of the principle of this invention and are not to be interpreted in a limited sense.

I claim:

1. A ring display with locking mechanism which comprises:

a case;

a plate supported by the case and including ring receiving slots;

at least one rod rotatably carried by the case and having its axis aligned generally below said slots;

a hook connected with said rod for rotation of the hook below the slots between a ring release and a ring retaining position;

an actuator carried movably by the plate, positioned between the plate and rod, movable in a plane parallel to the plate and in directions substantially perpendicular to the axis of the rod;

a linkage bar attached to the rod extending upwardly through an aperture in the actuator and forming a pivotal connection, whereby moving the actuator perpendicular to the axis of the rod rotates the hook between said positions;

a spring connected between the actuator and case urging the actuator inwardly in a ring retaining position.

* * * * *